US010835920B2

(12) United States Patent
Singh et al.

(10) Patent No.: US 10,835,920 B2
(45) Date of Patent: Nov. 17, 2020

(54) TECHNOLOGY AND PROCESS FOR COATING A SUBSTRATE WITH SWARF PARTICLES

(71) Applicants: INDIAN INSTITUTE OF TECHNOLOGY ROPAR, Punjab (IN); SWINBURNE UNIVERSITY OF TECHNOLOGY, Hawthorn (AU)

(72) Inventors: Malkeet Singh, Punjab (IN); Harpreet Singh, Punjab (IN); Christopher Charles Berndt, Hawthorn (AU)

(73) Assignees: INDIAN INSTITUTE OF TECHNOLOGY ROPAR (IN); SWINBURNE UNIVERSITY OF TECHNOLOGY (AU)

( * ) Notice: Subject to any disclaimer, the term of this patent is extended or adjusted under 35 U.S.C. 154(b) by 38 days.

(21) Appl. No.: 16/352,331

(22) Filed: Mar. 13, 2019

(65) Prior Publication Data

US 2020/0038904 A1 Feb. 6, 2020

(30) Foreign Application Priority Data

Aug. 3, 2018 (IN) ..... 201811029355

(51) Int. Cl.
*B05C 19/04* (2006.01)
*B05C 19/00* (2006.01)

(52) U.S. Cl.
CPC ..... *B05C 19/04* (2013.01); *B05C 19/008* (2013.01)

(58) Field of Classification Search
None
See application file for complete search history.

(56) References Cited

U.S. PATENT DOCUMENTS

| | | | | |
|---|---|---|---|---|
| 2,354,727 A | | 8/1944 | Wulff | |
| 3,597,881 A | * | 8/1971 | Olton | B24B 7/12 451/299 |
| 3,922,821 A | * | 12/1975 | Canterbury | B24B 1/00 451/42 |
| 4,040,162 A | | 8/1977 | Isogai et al. | |
| 4,251,903 A | * | 2/1981 | Zacharias | B23B 5/08 29/28 |

(Continued)

FOREIGN PATENT DOCUMENTS

| | | | |
|---|---|---|---|
| CN | 103639412 | 3/2014 | B22F 3/115 |
| DE | 10 2010 014 747 | 10/2011 | B22F 3/10 |
| DE | 10 2015 002 967 | 10/2016 | B29C 67/00 |

*Primary Examiner* — Jethro M. Pence
(74) *Attorney, Agent, or Firm* — Hayes Soloway P.C.

(57) ABSTRACT

Disclosed is a technology being implemented in an apparatus for coating a substrate with swarf particles. The apparatus facilitates depositing metal coating onto metal surfaces, polymers, and ceramics. In this apparatus, the grinding process is retrofitted to deposit coatings onto substrates that range from soft (e.g., polymers and aluminium) to hard (e.g., glass-ceramic) materials. The apparatus comprises a sample holder, an infeed, and a grinding wheel. The sample holder holds a substrate to be coated with swarf particles. The infeed holding a work piece. The grinding wheel is mounted at a predefined height over the infeed. The apparatus is used to perform metal coating by depositing the swarf materials on surface of the substrate. It may be noted that the swarf materials are generated by grinding the work piece with the grinding wheel.

6 Claims, 7 Drawing Sheets

(56) References Cited

U.S. PATENT DOCUMENTS 4,285,324 A * 8/1981 Komanduri ..... B24B 53/12 125/11.01
4,339,896 A * 7/1982 Dennis ..... B24B 53/12 125/39
4,589,231 A * 5/1986 Roberts ..... B23Q 11/0046 451/216
4,607,459 A * 8/1986 Rees ..... B24B 3/36 248/302
4,919,824 A * 4/1990 Creps ..... B30B 9/20 100/121
5,645,471 A * 7/1997 Strecker ..... B24B 21/16 451/59
5,733,178 A * 3/1998 Ohishi ..... B24D 11/00 451/41
6,095,897 A * 8/2000 Stocker ..... B23Q 3/186 257/E21.23
6,267,657 B1 * 7/2001 Tawara ..... B23Q 11/0046 125/13.01
6,780,368 B2 8/2004 Liu et al.
8,826,938 B2 9/2014 Moore
2002/0061723 A1 * 5/2002 Duescher ..... B24D 18/00 451/527
2002/0090900 A1 * 7/2002 Telischak ..... B24D 7/12 451/359
2005/0064799 A1 * 3/2005 Raffaelli ..... B24D 5/00 451/42
2006/0172663 A1 * 8/2006 Zhang ..... B24B 53/017 451/5
2008/0113594 A1 * 5/2008 Carlson ..... B24B 21/02 451/296
2008/0160883 A1 * 7/2008 Benner ..... B24B 55/06 451/73
2008/0216413 A1 * 9/2008 Woo ..... B24D 11/02 51/295
2009/0098711 A1 * 4/2009 Sekiya ..... B81C 1/00873 438/460
2012/0178345 A1 * 7/2012 Wiand ..... B24D 5/10 451/42
2016/0009029 A1 1/2016 Cohen et al.
2016/0108302 A1 * 4/2016 Kitai ..... B24C 1/08 451/2
2018/0186091 A1 7/2018 Wu et al.
2019/0134782 A1 * 5/2019 Tateishi ..... B24B 7/228
2019/0291239 A1 * 9/2019 Yoshida ..... B24B 7/228

* cited by examiner

TECHNOLOGY AND PROCESS FOR COATING A SUBSTRATE WITH SWARF PARTICLES

CROSS-REFERENCE TO RELATED APPLICATIONS AND PRIORITY

The present application claims priority from Indian patent application 201811029355 filed on Aug. 3, 2018, the entirety of which is hereby incorporated by reference.

TECHNICAL FIELD

The present subject matter described herein, in general, relates to metal coatings; more specifically relates to coating the metal and other material substrates with swarf particles.

BACKGROUND

In the domain of surface engineering, there exist several techniques to develop surface coatings. One of the well-known coating processes is known as Thermal Spraying (TS). It may be noted that TS is an industrial coating process that consists of a heat source (flame or other) and a coating material in a powder or wire form that is melted into tiny droplets and then sprayed onto the surface at high speed. TS may facilitate in coating the surface as necessitated; however, it may require several costly hardware components (such as nozzle, gun and feedstock powder particles) and high skill for engineering applications. In addition to the above limitations, TS is very cumbersome and ineffective (most often not possible) technique to coat ceramics such as a glass surface.

SUMMARY

Before the present system and method are described, it is to be understood that this application is not limited to the particular machine or an apparatus, and methodologies described, as there can be multiple possible embodiments that are not expressly illustrated in the present disclosures. It is also to be understood that the terminology used in the description is for the purpose of describing the particular versions or embodiments only, and is not intended to limit the scope of the present application. This summary is provided to introduce aspects related to a technology being implemented in an apparatus for coating a substrate with swarf particles and the aspects are further elaborated below in the detailed description. This summary is not intended to identify essential features of the proposed subject matter nor is it intended for use in determining or limiting the scope of the proposed subject matter.

In one implementation, a technology being implemented in an apparatus for coating a substrate with swarf particles and providing a process for metal coating, named as a grind-coating process is disclosed. It may be noted that the proposed technology and technology deposits a metal coating onto metal surfaces, polymers, and ceramics. In this process, the conventional grinding process is retrofitted to deposit coatings. The apparatus comprises a sample holder, an infeed, and a grinding wheel. The sample holder holds a substrate to be coated with swarf particles. The infeed holds a work piece. The grinding wheel is mounted at a predefined height over the infeed. The apparatus is used to perform metal coating by depositing the swarf materials onto the surface of the substrate. It may be noted that the swarf materials are generated by grinding the work piece with the grinding wheel. In other words, the high speed of the grinding wheel helps to generate and deposit the material removed from the work piece (referred to as swarf material) onto a target surface (referred to as a substrate) as a coating.

It may be noted that the grinding wheel is rotating, on a spindle, at a predefined Rotations Per Minute (RPM) to deposit the swarf particles onto the substrate, when the grinding wheel is interfaced with the work piece. In one aspect, the swarf particles are deposited at a predefined speed and a predefined temperature. It may further be noted that the grinding process is retrofitted to deposit the coating on selected ranges of the substrates including, but not limited to, aluminum and polymer (representative of a soft material) and glass (representative of hard material).

BRIEF DESCRIPTION OF THE DRAWINGS

The foregoing summary, as well as the following detailed description of embodiments, is better understood when read in conjunction with the appended drawings. For the purpose of illustrating the disclosure, there is shown in the present document example constructions of the disclosure, however, the disclosure is not limited to the specific methods and apparatus disclosed in the document and the drawings.

The detailed description is described with reference to the accompanying figures. In the figures, the left-most digit(s) of a reference number identifies the figure in which the reference number first appears. The same numbers are used throughout the drawings to refer like features and components.

Figure 1:
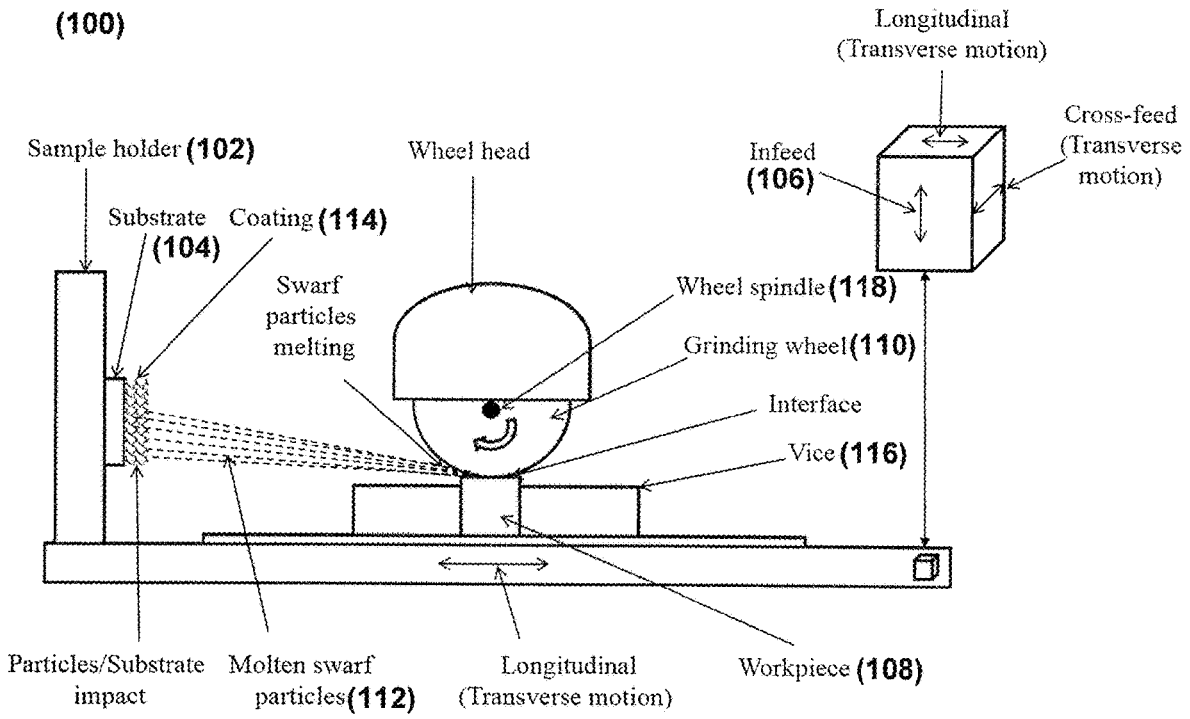
FIG. 1 illustrates a schematic diagram of the process and the set-up, in accordance with an embodiment of the present subject matter.

The figures depict various embodiments of the present disclosure for purposes of illustration only. One skilled in the art will readily recognize from the following discussion that alternative embodiments of the structures and methods illustrated herein may be employed without departing from the principles of the disclosure described herein.

DETAILED DESCRIPTION

Some embodiments of this disclosure, illustrating all its features, will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items. Although any systems and methods similar or equivalent to those described herein can be used in the practice or testing of embodiments of the present disclosure, the exemplary, systems and methods are now described. The disclosed embodiments are merely exemplary of the disclosure, which may be embodied in various forms.

Various modifications to the embodiment will be readily apparent to those skilled in the art and the generic principles herein may be applied to other embodiments. However, one of ordinary skill in the art will readily recognize that the present disclosure is not intended to be limited to the embodiments illustrated, but is to be accorded the widest scope consistent with the principles and features described herein.

The present invention discloses a technology and process that facilitates coating a substrate with swarf particles. In one embodiment, the technology may be used to deposit the swarf particles onto the substrate for metal coating. The substrate may include metal surfaces and ceramics. In order to deposit the swarf particles, the apparatus is deployed with a sample holder, an infeed, and a grinding wheel. The sample holder holds the substrate to be coated with swarf particles whereas the infeed holds a work piece. In one aspect, the sample holder holds the substrate perpendicularly to the infeed holding the work piece. The grinding wheel, on the other hand, is immovably affixed on top of the infeed under a wheel head. The grinding wheel is configured to rotate, on a spindle, at a predefined Rotations Per Minute (RPM) to deposit the swarf particles onto the substrate upon grinding the work piece, when the grinding wheel is interfaced with the work piece.

It may be noted that the grinding process is retrofitted to deposit the coating. The high speed of the grinding wheel helps to transfer the swarf particles, removed from the workpiece (referred to as swarf particles), towards the substrate. During grinding process, large amounts of the micro-sized particle are removed from the work piece by the grinding wheel subjected to the high rotational speed of the grinding wheel. It may further be noted that the rotational speed of the grinding wheel may be controlled by a controller. Post removal of the swarf particles from the work piece due to the grinding process, the swarf particles are thrown towards the substrate which then adhere on the substrate with a proper splat formation.

Now referring to FIG. 1, the schematic diagram of the apparatus 100 illustrating grind coating is shown in the FIG. 1. As described earlier, the apparatus 100 comprises a sample holder 102 holding the substrate 104. The apparatus further comprises the infeed 106 holding the work piece 108. In one aspect, the work piece 108 can be moved either X-axis or Y-axis by moving the infeed 106 in the Cross Feed transverse motion and Longitudinal transverse motion respectively. The apparatus 100 further comprises a grinding wheel 110 immovably positioned above the work piece 108.

In order to coat the substrate 104, the grinding wheel 110 is enabled to rotate at a desired Rotations Per Minute (RPM) speed. Once the grinding wheel 110 is rotated at the desired RPM speed, the work piece 108 is moved transversally or upwardly until the work piece 108 is interfaced with the grinding wheel 110. The work piece 108 is interfaced with the grinding wheel 110 to grind the work piece 108. The grinding of the work piece by the grinding wheel, at high RPM, produces a stream of molten swarf particles 112 (hereinafter may also be referred to as swarf particles 112 or a stream of randomly sized swarf particles 112), that is then thrown towards the substrate 104, as shown in the FIG. 1.

Figure 2:
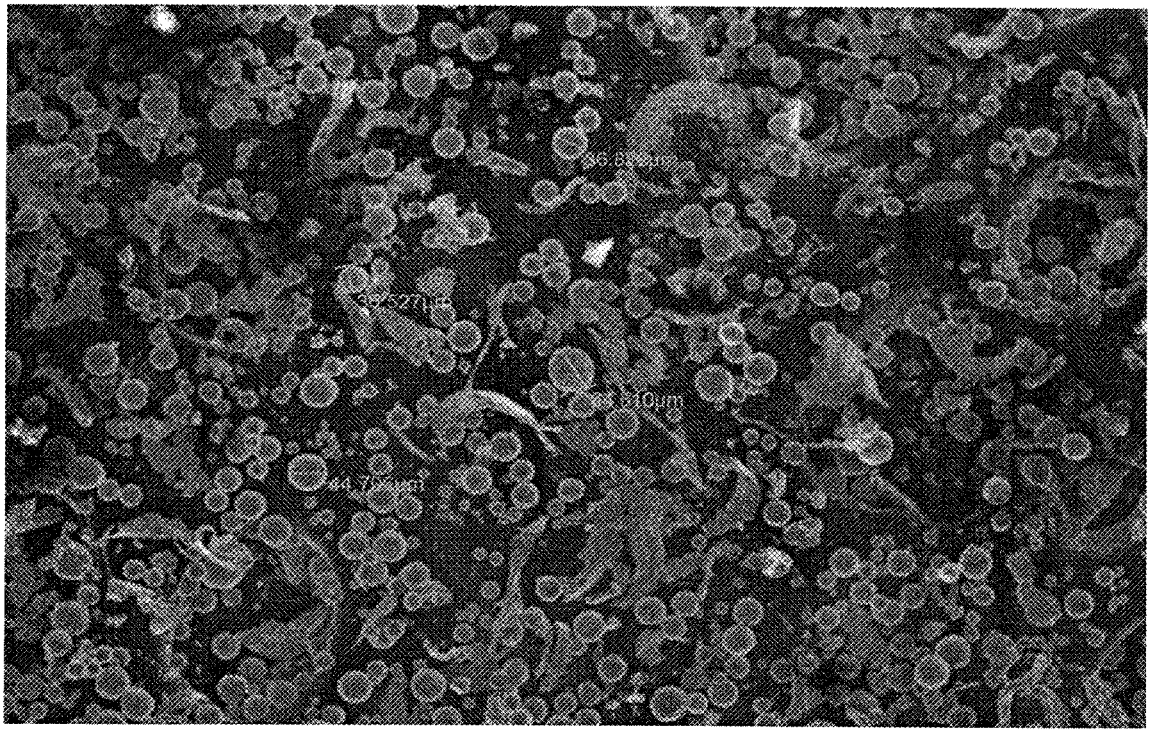
FIG. 2 illustrates analysis of micrometer-sized low carbon steel uncoated swarf produced during the grinding process, in accordance with an embodiment of the present subject matter.

It may be noted that the stream of the molten swarf particles 112 may comprise random sized micro particles, as shown in FIG. 2, that may result in better adhesion strength of the coating 114. This stream of the molten swarf particles 112 removed from the work piece 108 is deposited onto a target surface (referred to as a substrate 104) as a coating 114.

It may be noted that the swarf particles 112 have a high temperature due to grinding friction and are deposited at a high speed due the rotating speed of the grinding wheel 110. In one aspect, the speed and the temperature of the swarf particles (112) may be changed based on at least one of a grinding time and a set of grinding variables. Examples of the set of grinding variables may include, but not limited to, Cross Feed transverse motion, Longitudinal transverse feed, Rotations Per Minute (RPM) of the grinding wheel, and stand-off distance between the work piece 108 and the substrate 104.

As a result of high impact speed and elevated temperature, the swarf particles 112 get deposited onto the substrate 104. It may further be noted that the swarf particles 112 may be deposited in at least one shape comprising spherical, needle and platelet. In one aspect, the shape and size of the swarf particles 112 may be changed by altering a value pertaining to at least one grinding variable of the set of grinding variables.

In order to support the aforementioned description, various experiments have been performed in an open environment. The experimental data of one such experiment is given below. The temperature of the substrate 104 at the start of grinding process is kept at the room temperature. It may be noted that the temperature of the substrate 104 is constantly increased due to continuous striking of the swarf particles 112 onto the substrate 104 i.e. a coating process. This increase in the temperature of the substrate 104 during the coating process is found to be directly proportional to grinding time.

In order to further elucidate the capability of the apparatus 100, both aluminum and glass are used as the substrate 104 on which coating 114 needs to be performed in experimentation. It may be noted that the work piece 108 for this experimentation is used as solid steel material. A plate of the solid steel material is fixed on a vice 116 below the grinding wheel 110. Before starting the grinding process, the infeed 106 is moved so as to bring the work piece 108 in contact with the grinding wheel 110. During the grinding process, friction occurs between the grinding wheel 110 and the workpiece 108. As a result of that, a stream of randomly sized swarf particles 112 is generated and directed towards the substrate 104. Consequently, the solid steel material directly converts into the stream of randomly sized swarf particles 112, which will directly adhere on the substrate 104 as a coating 114.

Example 1

Figure 5:
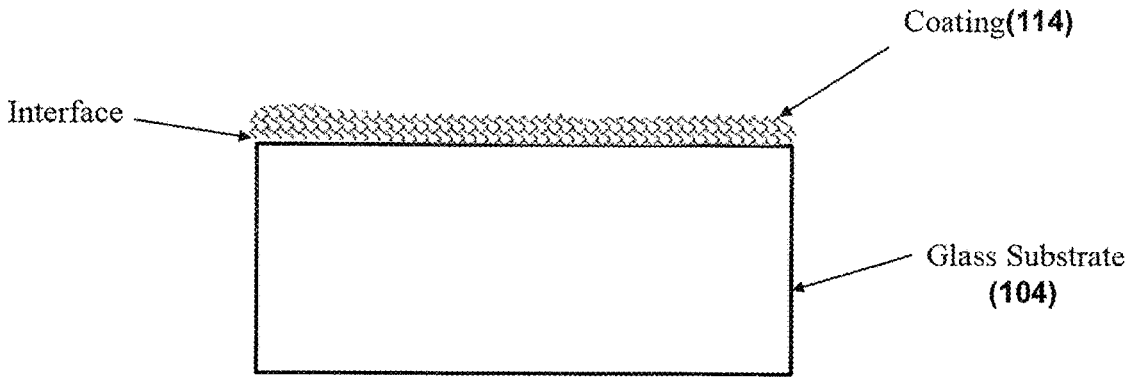
FIG. 5 illustrates glass samples coated with low carbon steel swarf by the grind-coating process, in accordance with an embodiment of the present subject matter.

While using the solid steel material as the work piece 108, low carbon steel swarf particles are directed by the grinding wheel 110 during the grind processing in accordance with the preferred parameters as mentioned below in Table 1. It has been observed that the coating of the low carbon steel swarf particles is 1.8 mm (about 1800 μm) thick and micro-hardness within the range between 162 HV to 536 HV. The proposed technique of coating by using the apparatus 100 may help in achieving a coating thickness in the range between 1.5 mm to 3.5 mm. In one embodiment, coating of low carbon steel swarf on the substrate 104 like aluminum and glass are shown in FIGS. 3 and 5 respectively.

TABLE 1

| Sr. No | Substrate Material | Coating | Stand-off distance (mm) | Rotational speed of the rational wheel (RPM) |
|---|---|---|---|---|
| 1 | Aluminum | Low carbon steel swarf particles | Up to 250 | Up to 5670 |
| 2 | Glass | Low carbon steel swarf particles | Up to 250 | Up to 5670 |
| 3 | Polymer | Low carbon steel swarf particles | Up to 250 | Up to 5670 |

Figure 3:
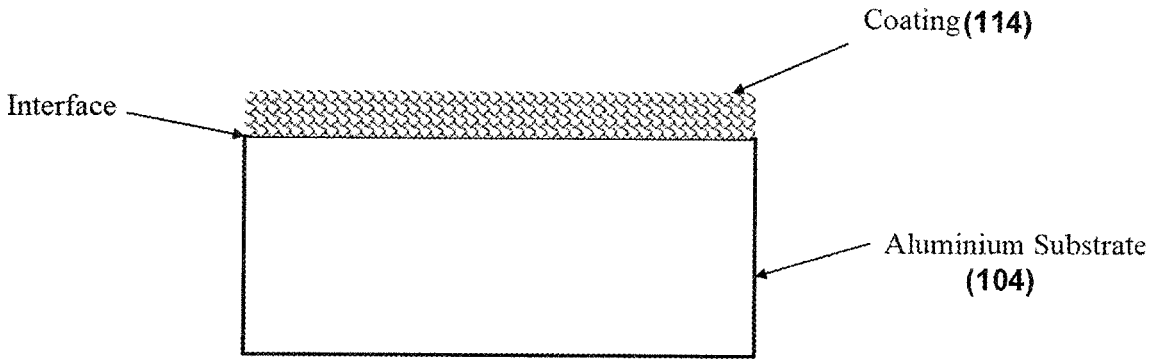
FIG. 3 illustrates aluminum samples coated with low carbon steel swarf by the grind-coating process, in accordance with an embodiment of the present subject matter.
Figure 4:
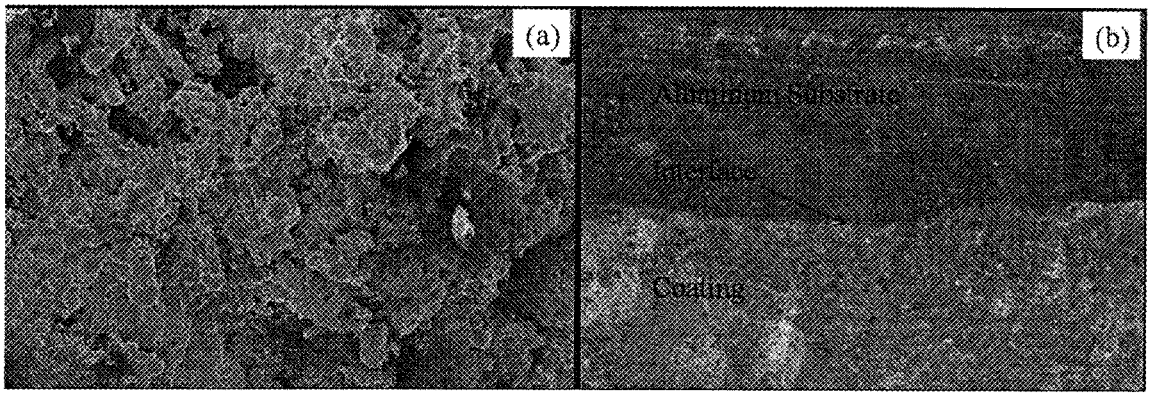
FIG. 4 illustrates analysis of the low carbon steel swarf coating on aluminum by grind-coating process (a) Surface analysis (b) Cross-sectional, in accordance with an embodiment of the present subject matter.

Referring to FIGS. 3 and 4 considering the low carbon steel is used as the workpiece 108 and aluminum is used as the substrate 104. The FIGS. 3 and 4 demonstrate metal coated aluminum substrate suitable for the cavity filling, making the 3D metal part and repairing defective surface is produced.

Figure 6:
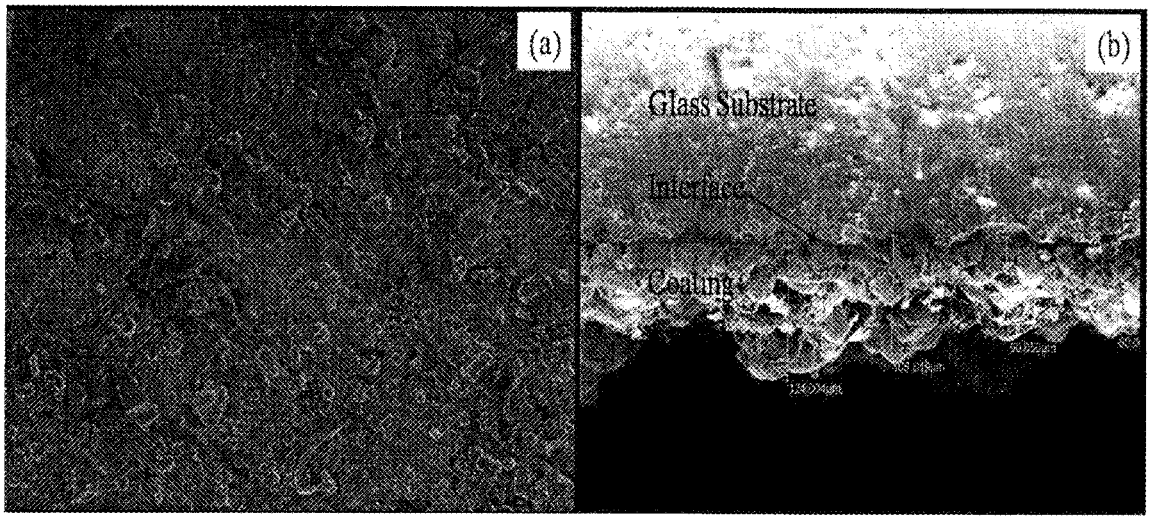
FIG. 6 illustrates analysis of the low carbon steel swarf coating on glass by grind-coating process (a) Surface analysis (b) Cross-sectional, in accordance with an embodiment of the present subject matter.

Referring to FIGS. 5 and 6 considering the low carbon steel is used as the workpiece 108 and glass is used as the substrate 104. It may be noted that the coating on glass is always a challenging task, due to its hardness, high surface finishing and difficult to deform. By coating the glass using the swarf particles generated from the low carbon steel, it becomes possible to coat the glass as well and create several applications from the coated glass including, but not limited to, decoration, accidental glass repairing and opaque glass coatings by using the apparatus 100, as shown in the FIGS. 5 and 6.

Figure 7:
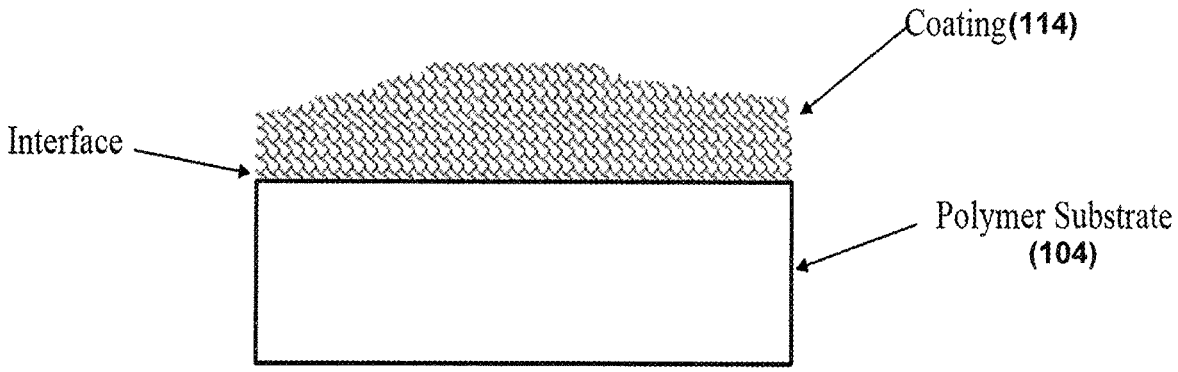
FIG. 7 illustrates acrylic polymer (used as the substrate) samples coated with low carbon steel (used as the workpiece) swarf by the coating process, in accordance with an embodiment of the present subject matter.

Referring to FIG. 7 illustrates acrylic polymer (used as the substrate 104) samples coated with low carbon steel (used as the workpiece 108) swarf by the coating process, in accordance with an embodiment of the present subject matter. It may be noted that the metal coating on an acrylic polymer is a challenging task due to its low melting point. In one aspect, the acrylic polymer coated with metal is suitable for several applications including, but not limited to, decoration, accidental polymer repairing and opaque polymer coatings.

To illustrate the capabilities of the apparatus (100), the description has been described with two ranges of the substrates for coatings from soft materials (including Polymer and Aluminum) to hard materials (including Glass) as mentioned in Table 1. Further it may be possible to perform the metal coating using said technology being implemented in the apparatus (100) for a wide range of other substrates which have properties of soft as well as hard material and are not mentioned in this description.

Exemplary embodiments discussed above may provide certain advantages. Though not required to practice aspects of the disclosure, these advantages may include those provided by the following features.

The present apparatus is a sustainable and cost effective coating process as the waste material arising out of the grinding operation is used for many engineering applications.

The present apparatus facilitates coating hard materials like glass which may not be possible with other coating techniques including Thermal Spraying.

The present apparatus processes may be used to achieve a dense metal coating with an excellent bonding.

The invention claimed is:

1. An apparatus for coating a substrate with swarf particles, the apparatus comprising:

a sample holder for holding a substrate to be coated with swarf particles;

an infeed holding a work piece; and a grinding wheel mounted at a predefined height over the infeed, wherein the grinding wheel is rotating on a spindle at a predefined Rotations Per Minute (RPM) to deposit the swarf particles onto the substrate held by the sample holder with a predefined speed and a predefined temperature when the grinding wheel is interfaced with the work piece, thereby coating the substrate with the swarf particles.

2. The apparatus as claimed in claim 1, wherein the substrate comprises at least one of: an aluminum or a glass.

3. The apparatus as claimed in claim 1, wherein the swarf particles are generated upon grinding the work piece at the predefined RPM.

4. The apparatus as claimed in claim 1, wherein the swarf particles are deposited in at least one shape comprising spherical, needle or platelet, and wherein the shape is interchanged based on a set of grinding variables.

5. The apparatus as claimed in claim 4, wherein the set of grinding variables comprises: Cross Feed transverse motion, Longitudinal transverse feed, Rotations Per Minute (RPM) of the grinding wheel, and stand-off distance between the work piece and the substrate.

6. The apparatus as claimed in claim 1, wherein the predefined speed and the predefined temperature of the swarf particles are changed based on at least one of: a grinding time or the set of grinding variables.

* * * * *